United States Patent [19]

Tahara

[11] Patent Number: 4,627,380

[45] Date of Patent: Dec. 9, 1986

[54] MARKING APPARATUS FOR COLORING LATERAL EDGE OF SHEET

[75] Inventor: Yoshinori Tahara, Numazu, Japan

[73] Assignee: Mei San Co., Ltd., Japan

[21] Appl. No.: 745,626

[22] Filed: Jun. 17, 1985

[30] Foreign Application Priority Data

Mar. 9, 1985 [JP] Japan ..... 60-47292

[51] Int. Cl.[4] ..... B05C 11/00

[52] U.S. Cl. ..... 118/77; 118/38; 118/44

[58] Field of Search ..... 427/11, 284, 285; 118/77, 211, 38, 44

[56] References Cited

U.S. PATENT DOCUMENTS 3,644,934 2/1972 Hawkins et al. ..... 65/158 X 3,793,983 2/1974 Shelestak ..... 118/77 X

*Primary Examiner*—Evan K. Lawrence

*Attorney, Agent, or Firm*—Hoffmann, Dilworth, Barrese & Baron

[57] ABSTRACT

A marking apparatus for coloring a lateral edge of a sheet moving along its longitudinal axis includes a marking head including a body and a tubular shaft mounted on the body for rotation about an axis of said shaft. A roller is fixedly mounted on the tubular shaft for rotation therewith. An elongated coloring element of a solid material is received in the tubular shaft for rotation therewith and has one end extending outwardly of one end of the tubular shaft a predetermined distance. An actuator is operable to move the marking head in a plane perpendicular to the plane of the sheet parallel to a plane in which the lateral edge of the sheet lies so as to bring an end face of the one end of the coloring element into contact with the lateral edge of the sheet to apply a marking thereto. The axis of the tubular shaft is disposed transversely of a path of travel of the sheet and inclined with respect to the plane of the sheet.

5 Claims, 12 Drawing Figures

18
10a
14
16
64
66
18
14a
20
22
22a
14b
24
42
36a
26
22c
44c
48
46
36
22b
44
30a
32a
30b
32b
36b
60
62
52
56
60
54
36c
28
32
28a
34
28
28a
56a
32c
32d
44a
58
S1
54
S2
44b
34
S2

14
10c
64
64
74
14a
72
32
54
34
34
S3

MARKING APPARATUS FOR COLORING LATERAL EDGE OF SHEET

BACKGROUND OF THE INVENTION

1. Field of the Invention

This invention relates to a marking apparatus for coloring a lateral edge of a continuous sheet, for example, of paper moving in a direction of the length thereof.

2. Prior Art

Generally, a sheet of paper is continuously produced by a paper machine, and a continuous length of plastics film is produced by extrusion. Such sheet and film (hereinafter referred to as "sheet") are relatively wide and therefore need to be cut widthwise to a suitable size. An apparatus for cutting a sheet is commonly known in the trade as a winder which advances a sheet longitudinally and cuts it widthwise into a plurality of narrower sheets, the sheets thus cut being rolled up a predetermined length. Another cutting apparatus is known in the trade as a sheet cutter which advances a sheet longitudinally, cuts the sheet widthwise into a plurality of narrower sheets, and then cuts each segments longitudinally into rectangular sheets which are stacked one upon another.

The sheet processed by the above winder and sheet cutter may have defects such as a hole and irregularities on a sheet surface, and it has been proposed to detect such defects and apply a marking to a lateral edge of the sheet at a position disposed in registry with the defect on the sheet so that even after the sheet is either rolled up or stacked, the defect can be easily located visually from the outside thereof. The marking indicative of the detect is applied to the lateral edge of the sheet because such a smeared edge hardly affects the quality of the final sheet. Japanese Patent Application Laid-Open (Kokai) No. 58-114899 filed Dec. 26, 1981 discloses a marking apparatus for coloring the lateral edge of the sheet with a coloring element of a solid material resembling a crayon. This marking apparatus is advantageous over a marking apparatus employing ink or liquid coloring material because it does not suffer from the problem of ink leakage. However, it is rather difficult to bring the coloring element into proper contact with the lateral edge of the sheet. More specifically, the conventional marking apparatus comprises a roller, and a coloring element of a solid material mounted coaxially within the roller for rotation therewith. The roller is movable toward one of sheets advancing in juxtaposed relation in a common plane, so that it is brought into engagement with the advancing sheet to be driven for rotation and displaces it out of the common plane to expose the lateral edge of the adjoining sheet. One end of the coloring element is brought into contact with the exposed lateral edge of the adjoining sheet to provide a colored marking thereto. As shown in FIG. 1A, the coloring element C is disposed in such a manner as to slightly overlap the sheet S an amount O. If the amount O is excessive, the end of the coloring element C is brought into contact not with the lateral edge of the sheet S but with the marginal portion of the sheet S, as best shown in FIG. 1B. This will affect the quality of the final sheet. In addition, when the marking operation is carried out in this condition, the peripheral surface of the coloring element C adjacent to the end face thereof is worn as shown in FIGS. 1C and 1D to aggravate the

SUMMARY OF THE INVENTION

It is therefore an object of this invention to provide a marking apparatus in which the coloring element of a solid material can be brought into proper contact with the lateral edge of the sheet at one end face thereof.

According to the present invention, there is provided a marking apparatus for coloring a lateral edge of a sheet moving along its longitudinal axis which comprises:

(a) a marking head comprising (i) a body, (ii) a tubular shaft mounted on the body for rotation about an axis of said shaft, (iii) a roller fixedly mounted on the tubular shaft for rotation therewith,(iv) an elongated coloring element of a solid material received in the tubular shaft and having one end extending outwardly of one end of the tubular shaft a predetermined distance, and (v) means for preventing the rotation of the coloring element relative to the tubular shaft; and (b) an actuator operable to move the marking head in a plane perpendicular to the plane of the sheet in which the lateral edge of the sheet lies so as to bring an end face of the one end of the coloring element into contact with the lateral edge of the sheet to apply a marking thereto, the axis of the tubular shaft being disposed transversely of a path of travel of the sheet and inclined with respect to the plane of the sheet with the one end of the tubular shaft being closer to the plane of the sheet than the other end of the tubular shaft.

DESCRIPTION OF THE PREFERRED EMBODIMENTS OF THE INVENTION

Figure 2:
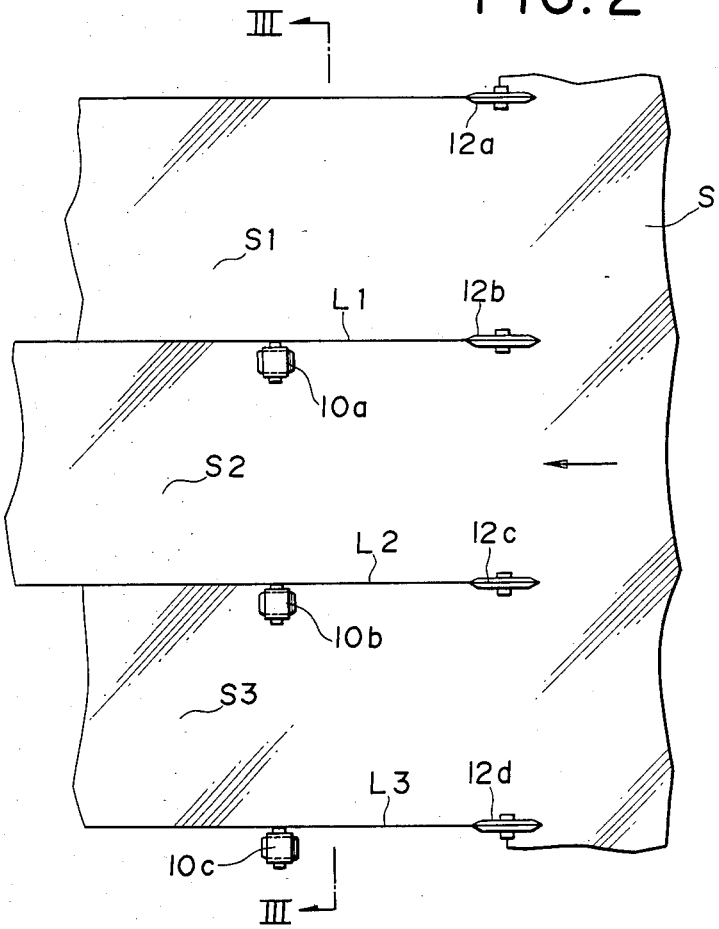
FIG. 2 is a plan view of a plurality of marking apparatuses provided in accordance with the present invention.
Figure 3:
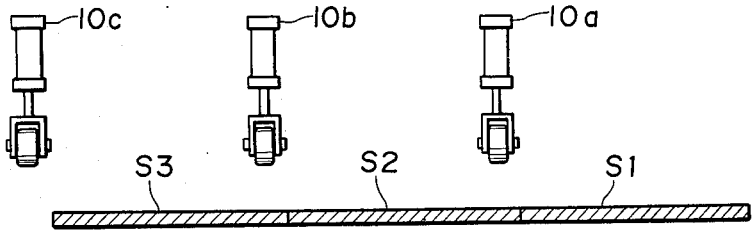
FIG. 3 is cross-sectional view taken along the line III—III of FIG. 2.

Three marking apparatuses 10*a*, 10*b* and 10*c* are mounted above a sheet S through supporting means (not shown) and spaced from one another transversely of the sheet S, the sheet S being advanced in the direction of the length thereof as indicated by an arrow in FIG. 2. The sheet S is cut widthwise by slitters 12*a* to 12*d* along lines L1 to L3 of cutting into three sheets S1, S2 and S3 of a narrower width. The three marking apparatuses 10*a* to 10*c* are disposed adjacent respectively to planes disposed perpendicular to the plane of the sheet S and containing the lines L1 and L3 of cutting.

Figure 4:
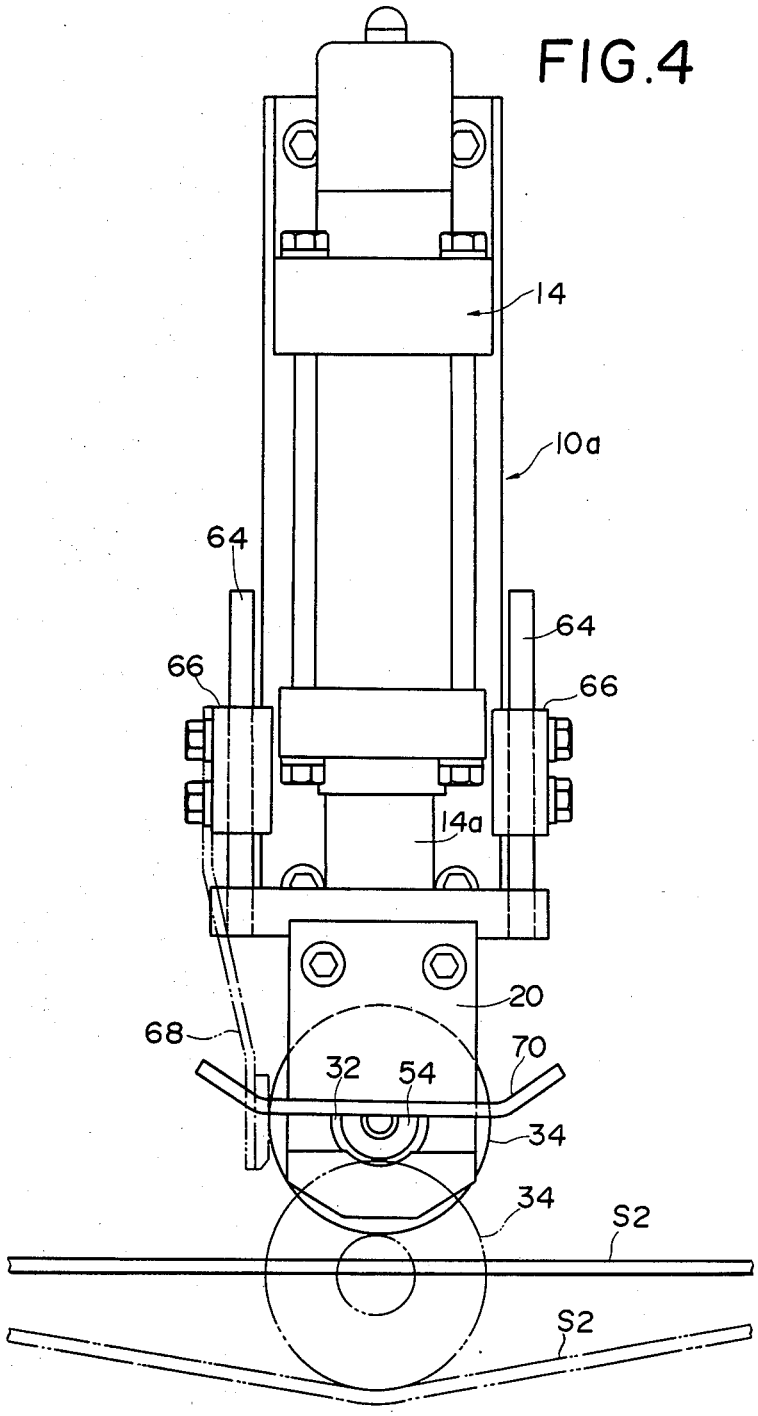
FIG. 4 is a side-elevational view of the marking apparatus.
Figure 5:
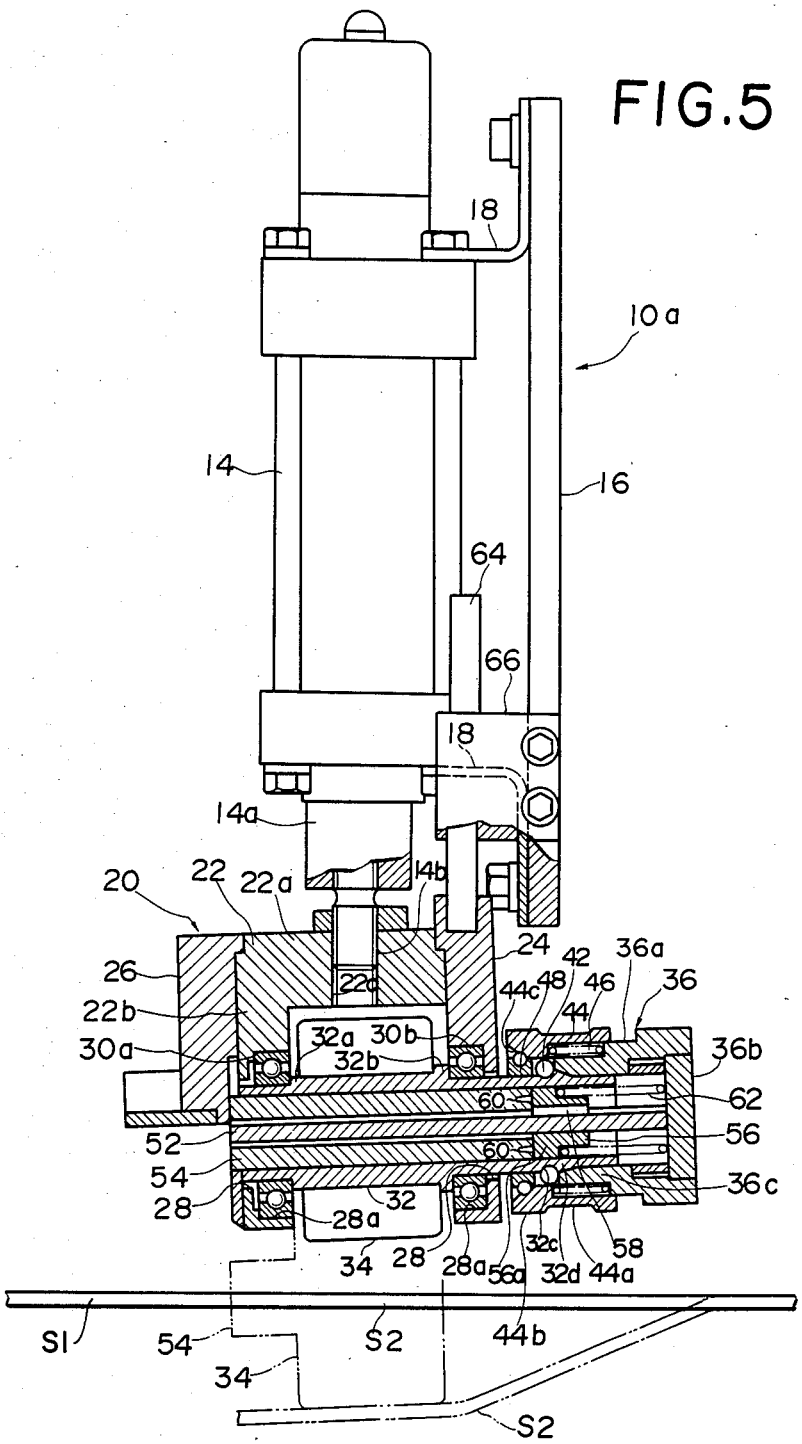
FIG. 5 is a partly-broken front elevational view of the marking apparatus.

The marking apparatus 10*a* will now be described with particular reference to FIGS. 4 and 5. The marking apparatus 10*a* comprises an actuator in the form of a pneumatic cylinder 14 having a piston rod 14*a* operatively connected therewith for vertical movement along its axis. A mounting plate 16 is fixedly secured to the pneumatic cylinder 14 through a pair of brackets 18, the mounting plate 16 being mounted on a frame (not shown) extending above and transversely of the sheet S. The mounting plate 16 and the pneumatic cylinder 14 are disposed vertically, that is, perpendicular to the plane of the sheet S. A marking head 20 is mounted on the distal end of the piston rod 14*a*. More specifically, the marking head 20 comprises a body 22 of an inverted L-shaped cross-section defined by perpendicularly-disposed first and second legs 22*a* and 22*b*, a first plate 24 secured to an end of the first leg 22*a* in parallel opposed relation to the second leg 22*b* to define together with the body 22 a channel-shaped structure, and a second plate 26 secured to the surface of the second leg 22*b* facing away from the first plate 24. An internally-threaded aperture 22*c* is formed through the first leg 22*a*, and the piston rod 14*a* has an externally-threaded portion 14*b* at its distal end. The externally-threaded end of the piston rod 14*a* is screwed into the internally-threaded aperture 22*c*, so that the marking head 20 carried by the piston rod 14*a* is moved vertically toward and away from the plane of the sheet S upon actuation of the pneumatic cylinder 14. The first leg 22*a* of the body 22 is inclined with respect to a plane perpendicular to the piston rod 14*a*, with the first leg 22*a* sloping downwardly toward the end thereof remote from the first plate 24.

The first plate 24 and the second leg 22*b* of the body 22 have aligned apertures 28, respectively, and each of the apertures 28 has a counterbore 28*a*. A pair of annular bearing members 30*a* and 30*b* are received in the counterbores 28*a*, respectively. A tubular shaft 32 is borne by the pair of bearing members 30*a* and 30*b* for rotation about an axis thereof. The tubular shaft 32 is reduced in diameter at one end portion to form a peripheral shoulder 32*a*, the one end portion being received in the bearing member 30*a* with the shoulder 32*a* engaging the bearing member 30*a*. The tubular shaft 32 has a peripheral flange 32*b* intermediate opposite ends thereof which flange engages the bearing member 30*b*, so that the axial movement of the tubular shaft 32 is prevented. One end of the tubular shaft 32 disposed flush with the second leg 22*b* of the body while the other end extends outwardly of the first plate 24.

A roller 34 is fixedly mounted on the tubular shaft 32 for rotation therewith and disposed between the first plate 24 and the second leg 22*b* of the body 22. The axis of the tubular shaft 32 is inclined with respect to a plane perpendicular to the axis of the piston rod 14*a*, that is, a plane perpendicular to the plane of the sheet S.

The tubular shaft 32 has a peripheral groove 32*c* formed in an outer surface thereof and disposed intermediate the first plate 24 and the other end thereof remote from the bearing 30*a*. A peripheral ridge 32*d* is formed around the outer surface of the tubular shaft 32 immediately adjacent to the peripheral groove 32*c* and tapers toward the other end of the tubular shaft 32.

Figure 6:
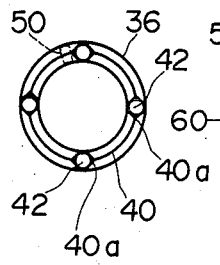
FIG. 6 is an end view of a cap member, showing a circular spring attached thereto.

A cap member 36 is removably attached to the other end of the tubular shaft 32, the cap member 36 having a stepped tubular portion 36*a* and an end wall 36*b* closing one end of the tubular portion 36*a*. As best shown in FIG. 6, a circular spring 40 is attached to an open end of the cap member 36 and has four loop portions 40*a* spaced equally circumferentially. Four steel balls 42 are held in the four loop portions 40*a*, respectively. By virtue of the provision of the circular spring 40, the four steel balls 42 are radially displaceable resiliently. A retainer ring 44 for retaining the cap member 36 is also removably attached onto the other end of the tubular shaft 32. The retainer ring 44 has a thinned portion 44*a* extending axially from a point intermediate opposite ends thereof to one end. The stepped end portion 36*c* of the tubular portion 36*a* of the cap member 36 is received in the thinned portion 44*a* in radially spaced relation thereto to provide an annular space therebetween. A compression spring 46 is received in this annular space and acts between the cap member 36 and the retainer ring 44. The four steel balls 42 are snappingly fitted in the peripheral groove 32*c* and held in position by a thickened portion 44*b* extending from the thinned portion 44*a*, thereby retaining the cap member 36 in place. The inner surface of the thickened portion 44*b* adjacent to the end thereof flares outwardly to provide a tapered surface 44*c*. The tapered surface 44*c* is urged by the compression spring 46 into engagement with an abutment ring 48 fixedly mounted on the tubular shaft 32. For removing the cap member 36 from the tubular shaft 32, the retainer ring 44 is moved toward the cap member 36 along the axis of the tubular shaft 32 against the bias of the compression spring 46, so that the tapered surface 44*c* is brought into registry with the four balls 42. Then, the cap member 36 is pulled in a direction away from the retainer ring 44, so that the steel balls 42 are caused to slide over the peripheral ridge 32*d*, and the cap member 36 are disengaged from the tubular shaft 32. A projection 50 is formed in the peripheral groove 32*c* of the tubular shaft 32 as indicated in a broken line in FIG. 6 for engagement with one of the steel balls 42 to prevent the rotation of the cap member 36 relative to the tubular shaft 32, so that the cap member 36 is rotated together with the tubular shaft 32.

Figure 7:
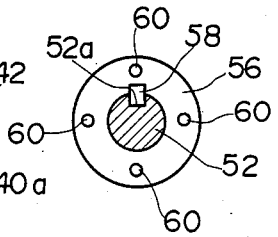
FIG. 7 is an end view of a movable tubular member.

A stem 52 of a circular cross-section is fixedly secured at one end to the inner surface of the end wall 36*b* and extending through the tubular shaft 32 in coaxial relation thereto, the free end of the stem 52 slightly projecting beyond the one end of the tubular shaft 32. A tubular coloring element 54 of a solid material is received in the tubular shaft 32, and the stem 52 extends into the coloring element 54. The coloring element 54 has an outer diameter slightly smaller than the inner diameter of the tubular shaft 32 and an inner diameter slightly greater than the outer diameter of the stem 52 so that the coloring element 54 is movable along the tubular shaft 32 and the stem 52. A tubular movable member 56 is mounted on the stem 52 for movement therealong, the movable member 56 having a flanged end 56*a*. As best shown in FIG. 7, the movable member 56 has a key member 58 fixedly secured to an inner surface thereof which key member is slidably received in a longitudinal groove 52*a* formed in the stem 52 for movement therealong. Four pointed projections or needles 60 are formed on the end face of the flanged end 56*a* of the movable member 56 and directed away from the cap member 36 along the axis thereof. The pointed projections 60 are spaced equally circumferentially from one another and stuck into the end face of the coloring element 54 remote from the second plate 26, so that the coloring element 54 is rotated together with the cap member 36, the tubular shaft 32 and the roller 34. A compression spring 62 is wound around the stem 52 and acts between the end wall 36b of the cap member 36 and the flanged end 56a of the movable member 56 to urge the movable member 56 and the coloring element 54 in a direction away from the cap member 36, so that the free end of the coloring element 54 is held against the second plate 26.

As described above, since the axis of the tubular shaft 32 is inclined with respect to the plane of the sheet S, the coloring element 54 is also inclined with respect to the plane of the sheet S. A pair of vertically-disposed guide rods 64 are fixedly secured at their lower ends to the first plate 24 and are slidably supported respectively by a pair of guide members 66 fixedly secured to the mounting plate 16.

The operation of the marking apparatus 10a will now be described. The narrow sheets S1, S2 and S3 are moved in a horizontal plane in the direction indicated by the arrow in FIG. 2. When a defect on the narrow sheet S1 is detected by a suitable sensor (not shown), the pneumatic cylinder 14 is operated to extend the piston rod 14a vertically downwardly to lower the marking head 20, so that the roller 34 is brought into contact with the marginal portion of the narrow sheet S2 adjacent to the narrow sheet S1 to displace it out of the plane of the sheet S1 to expose the lateral edge of the sheet S1 adjacent to the sheet S2. In this condition, the roller 34 held in contact with the moving sheet S2 is driven by it for rotation together with the tubular shaft 32 and the coloring element 54. And, the free end of the rotating coloring element 54 remote from the movable member 56 is brought into contact with that portion of the lateral edge of the sheet S1 disposed in registry with the above-mentioned defect to apply a colored marking thereto. Then, the piston rod 14a is moved upwardly together with the marking head 20 away from the sheets S1 and S2.

Figure 8:
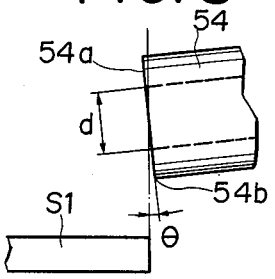
FIG. 8 is a schematic view showing the relation between a coloring element of the marking apparatus and a sheet.
Figure 1A:
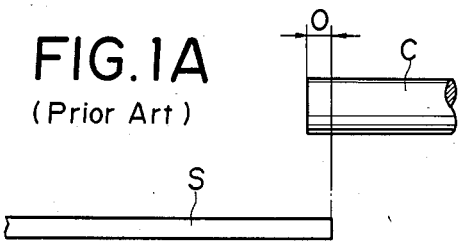
FIG. 1A (Prior Art)
FIGS. 1A to 1D are schematic views of a portion of a marking apparatus according to the prior art, showing the sequence of a marking operation.
Figure 1B:
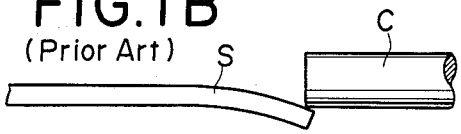
FIG. 1B (Prior Art)
Figure 1C:
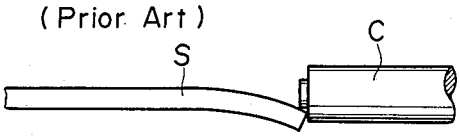
FIG. 1C (Prior Art)
Figure 1D:
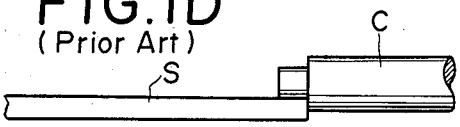
FIG. 1D (Prior Art)

The axis of the tubular shaft 32 is disposed transversely of a path of travel of the sheet S1 and inclined with respect to the plane of the sheet S1 with the one end remote from the cap member 36 being closer to the plane of the sheet S1 than the other end. More specifically, as shown in FIG. 8, the axis of rotation of the coloring element 54 is inclined with respect to the lateral edge of the sheet S1, the end face 54a of the coloring element 54 perpendicular to the axis thereof is inclined at an angle $\theta$ with respect to a plane which is perpendicular to the plane of the sheet S1 and in which the lateral edge of the sheet S1 lies. With this arrangement, as the marking head 20 is moved downwardly toward the sheet S2, the end face 54a of the coloring element 54 progressively approaches the lateral edge of the sheet S1 in a direction generally parallel to the plane of the sheet S1, so that the end face 54a of the coloring element 54 is positively brought into contact with the lateral edge. It will be appreciated that the marking apparatus 10a is positioned in such a manner that the lower edge 54b will not be brought into contact with the marginal portion of the sheet S1 when the marking head 20 is lowered. Preferably, the lateral edge of the sheet S1 is in contact with the end face 54a of the coloring element 54 within the inner diameter of the coloring element 54, so that the end face 54a can be worn uniformly.

Reference numeral 68 designates brake means secured to the guide member 66 for engagement with the roller 34 for stopping the rotation thereof when the marking head 20 is moved from its lower to upper position. A foot member 70 is secured to the second plate 26 for engagement with the marginal portion of the sheet S1 for preventing a fluttering thereof.

The marking apparatus 10b for applying a marking to the lateral edge of the sheet S2 is identical in construction to the marking apparatus 10a.

Figure 9:
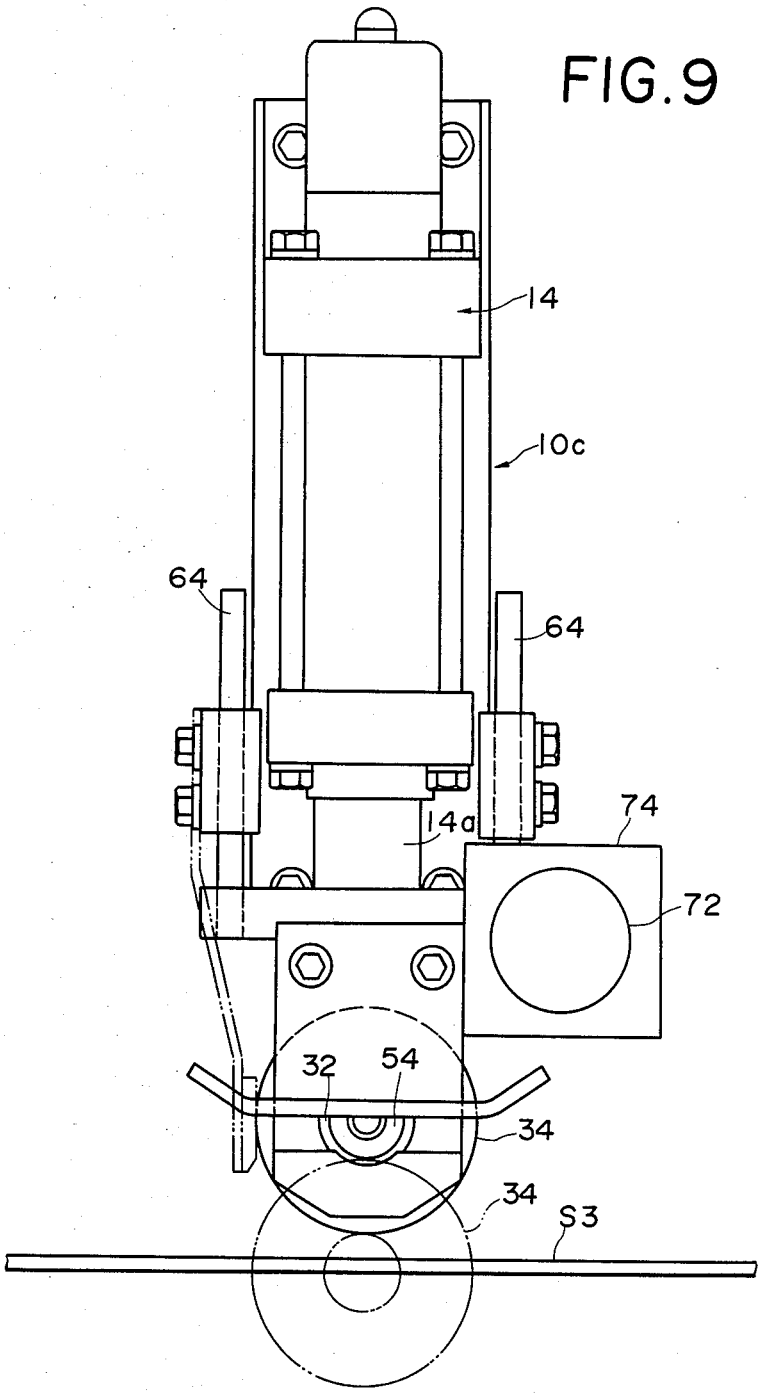

The marking apparatus 10c as best shown in FIG. 9 differs from the marking apparatus 10a in that an electric motor 72 is provided for driving the tubular shaft 32, the coloring element 54 and the roller 34 for rotation about their axes. The motor 72 is mounted on a mounting plate 74 secured to the marking head 20. An output shaft (not shown) of the motor 72 is operatively connected to the tubular shaft 32 by an endless belt (not shown) for rotating the tubular shaft 32. In operation, when a defect on the sheet S3 is detected, the marking head 20 is lowered by the pneumatic cylinder 14, and the motor 72 is driven for rotating the tubular shaft 32 and the coloring element 54, so that the end face of the coloring element 54 is brought into marking contact with the lateral edge of the sheet S3, as described above for the marking apparatus 10a.

While the marking apparatuses according to the present invention have been specifically shown and described herein, the invention itself is not to be restricted by the exact showing of the drawings or the description thereof. For example, although the marking apparatus is mounted above the sheet, it may be mounted below the sheet.

What is claimed is:

1. A marking apparatus for coloring a lateral edge of a sheet moving along its longitudinal axis which comprises:

(a) a marking head comprising (i) a body, (ii) a tubular shaft mounted on said body for rotation about an axis of said shaft, (iii) a roller fixedly mounted on said tubular shaft for rotation therewith, (iv) an elongated coloring element of a solid material received in said tubular shaft and having one end extending outwardly of one end of said tubular shaft a predetermined distance, and (v) means for preventing the rotation of said coloring element relative to said tubular shaft; and (b) an actuator operable to move said marking head in a plane perpendicular to the plane of the sheet in which the lateral edge of the sheet lies so as to bring an end face of the one end of said coloring element into contact with the lateral edge of the sheet to apply a marking thereto, the axis of said tubular shaft being disposed transversely of a path of travel of the sheet and inclined with respect to the plane of the sheet with one end of said tubular shaft being closer to the plane of the sheet than the other end of said tubular shaft.

2. A marking apparatus according to claim 1, in which said marking head comprises a motor for driving said roller for rotation about an axis thereof.

3. A marking apparatus according to claim 1, in which said coloring element is movable along said tubular shaft, said marking head comprising urging means for urging said coloring element to cause the one end thereof to project beyond the one end of said tubular shaft said predetermined distance.

4. A marking apparatus according to claim 3, in which said coloring element is of a tubular shape, said tubular shaft having a coaxial stem extending along an axis thereof which stem extends into said tubular coloring element, said rotation preventing means comprising a movable tubular member mounted on said stem for movement therealong and a key fixed to said movable tubular member and received in a groove in said stem for sliding movement therealong, said movable tubular member having pointed projections at one end, and said urging means urging said movable tubular member toward the other end of said coloring element so that said pointed projections are stuck therein for preventing the rotation of said coloring element relative to said tubular shaft.

5. A marking apparatus according to claim 1, in which said actuator comprises a power cylinder having a piston rod operatively associated therewith for movement along an axis thereof, said piston rod being connected to said marking head.

* * * * *